US010835069B2

(12) United States Patent
McDermott et al.

(10) Patent No.: US 10,835,069 B2
(45) Date of Patent: Nov. 17, 2020

(54) REINFORCED RUG TAB, REINFORCED RUG TAB KIT, AND METHOD OF USING THE SAME

(71) Applicant: OPTIMUM TECHNOLOGIES, INC., Cartersville, GA (US)

(72) Inventors: Sean S. McDermott, Atlanta, GA (US); Sean S. McDermott, Jr., Atlanta, GA (US)

(73) Assignee: OPTIMUM TECHNOLOGIES, INC., Cartersville, GA (US)

( * ) Notice: Subject to any disclaimer, the term of this patent is extended or adjusted under 35 U.S.C. 154(b) by 0 days.

(21) Appl. No.: 16/446,149

(22) Filed: Jun. 19, 2019

(65) Prior Publication Data

US 2019/0343316 A1 Nov. 14, 2019

Related U.S. Application Data

(60) Continuation-in-part of application No. 16/380,558, filed on Apr. 10, 2019, which is a division of application No. 15/441,885, filed on Feb. 24, 2017, now Pat. No. 10,292,518, which is a continuation of application No. 15/149,918, filed on May 9, 2016, now abandoned.

(51) Int. Cl.
*A47G 27/04* (2006.01)

(52) U.S. Cl.
CPC ..... *A47G 27/0418* (2013.01); *A47G 27/0412* (2013.01)

(58) Field of Classification Search
CPC ..... A47G 27/0406; A47G 27/0412; A47G 27/0418; A47G 27/0425; A47G 27/0431; A47G 27/0443; A47G 27/0475; A47G 27/0481
USPC ..... 16/4, 8, 9, 17.1
See application file for complete search history.

(56) References Cited

U.S. PATENT DOCUMENTS 2,042,692 A * 6/1936 Wurzburg ..... A47G 27/0418 442/150
3,014,829 A * 12/1961 Curtin ..... E04F 15/10 428/82
3,351,515 A * 11/1967 Muttera, Jr. ..... C09J 7/30 428/346

(Continued)

OTHER PUBLICATIONS

3M Repositionable Tapes, https://multimedia.3m.com/mws/media/1429300/repositionable-tapes-665-666-9415pc-9416-9425-9425ht-9449s.pdf (Year: 2011).

*Primary Examiner* — Jeffrey O'Brien
(74) *Attorney, Agent, or Firm* — Duane Morris LLP; Gregory M. Lefkowitz

(57) ABSTRACT

A reinforced rug tab is disclosed. The reinforced rug tab can include a reinforcing material, a first rug tab applied above the reinforcing material, and a second rug tab applied below the reinforcing material. The first rug tab can include a first tab upper adhesive layer, a first tab lower adhesive layer, and a first tab support material between the first tab upper adhesive layer and the first tab lower adhesive layer. The second rug tab can include a second tab upper adhesive layer, a second tab lower adhesive layer, and a second tab support material between the second tab upper adhesive layer and the second tab lower adhesive layer. A method of stabilizing a rug and a kit for stabilizing a rug using the rug tabs are also provided.

20 Claims, 7 Drawing Sheets

(56) References Cited

U.S. PATENT DOCUMENTS 5,672,402 A * 9/1997 Kreckel ..... A47G 1/175 428/34.2
5,902,658 A * 5/1999 Wyman ..... A47G 27/0412 428/40.1
6,231,962 B1 * 5/2001 Bries ..... B32B 5/18 428/317.3
6,558,786 B1 * 5/2003 Jupina ..... D06N 3/0043 428/316.6
7,182,989 B2 * 2/2007 Higgins ..... A47G 27/0293 428/51
7,464,510 B2 * 12/2008 Scott ..... A47G 27/0243
7,721,502 B2 * 5/2010 Scott ..... E04F 21/1657 52/506.05
7,757,457 B2 * 7/2010 Zah ..... A47G 27/0475 52/747.11
8,381,473 B2 * 2/2013 Scott ..... E04F 15/02 52/506.05
8,468,771 B2 * 6/2013 Gray ..... A47G 27/0481 52/747.11
8,648,771 B2 2/2014 Hwu et al.
9,085,902 B2 * 7/2015 Scott ..... G01S 1/68
9,200,183 B2 * 12/2015 Yao ..... C09J 7/22
10,081,133 B2 9/2018 Zoller
2011/0074128 A1 * 3/2011 Chang ..... C09J 7/22 280/87.042
2012/0285613 A1 * 11/2012 Bongiovanni ..... C09J 7/40 156/249
2016/0029826 A1 * 2/2016 Bongiovanni ..... B32B 38/10 156/249
2016/0135632 A1 * 5/2016 Wendling ..... A47G 27/045 428/41.7
2016/0135633 A1 * 5/2016 Wendling ..... A47G 27/0431 16/17.1
2018/0049574 A1 * 2/2018 Wendling ..... A47G 27/0431

* cited by examiner

REINFORCED RUG TAB, REINFORCED RUG TAB KIT, AND METHOD OF USING THE SAME

CROSS-REFERENCE TO RELATED APPLICATIONS

This application is a Continuation-in-Part of U.S. patent application Ser. No. 16/380,558, filed Apr. 10, 2019, which is a Divisional of U.S. patent application Ser. No. 15/441,885, filed Feb. 24, 2017, which is a Continuation of U.S. patent application Ser. No. 15/149,918, filed May 9, 2016, the entire contents of which are each incorporated herein by reference.

FIELD OF THE INVENTION

The invention is drawn to rug tabs for securing a rug to a target surface, such as a floor or wall, as well as, kits and methods of securing a rug to a target surface.

BACKGROUND OF THE INVENTION

Rugs and mats are frequently displayed in living areas, whether on the floor or on a wall. When displayed on a smooth surface, such as hard wood, tile, marble, etc., the rugs can slide. A variety of techniques have been developed for preventing sliding, including pads placed under the rug.

SUMMARY OF THE INVENTION

In one embodiment, a rug tab is provided. The rug tab can include a support material, having an upper side and a lower side; an upper adhesive layer applied on the upper side of the support material; and a lower adhesive layer applied on the lower side of the support material. The rug tab can be designed such that (i) an upper adhesive layer sheer force is at least 25% greater than a lower adhesive layer sheer force, (ii) an upper adhesive layer peel force is at least twice a lower adhesive layer peel force, or (iii) both options (i) and (ii), where the force values are measured one hour after application of a respective upper or lower adhesive layer to a target surface.

In another embodiment, a method of stabilizing a rug is provided. The method can include providing a rug tab supply, comprising a rug tab as provided herein; applying at least three rug tabs or at least four rug tabs from the rug tab supply to an underside of a rug using the upper adhesive layer; and applying the lower adhesive layer of each rug tab to a target surface. As part of the method, each of the at least three rug tabs or at least four rug tabs is applied proximate to an edge of the rug and each rug tab is spaced apart from the other rug tabs.

In yet another embodiment, a kit for stabilizing a rug is provided. The kit can include a rug tab supply, comprising a rug tab as provided herein, and instructions to the user. The instructions to the user can include applying at least three rug tabs or at least four rug tabs from the rug tab supply to an underside of a rug, proximate to an edge of the rug in a spaced apart arrangement, using the upper adhesive layer, and applying the lower adhesive layer of each rug tab to a target surface.

BRIEF DESCRIPTION OF THE DRAWINGS

The features and advantages of the present invention will be more fully disclosed in, or rendered obvious by the following detailed description of the preferred embodiments, which are to be considered together with the accompanying drawings wherein like numbers refer to like parts and further wherein:

FIG. 8A is a cross-sectional view of a rug tab as described herein with upper and lower releasable liners applied to the upper-most and lower-most adhesive layers, while

DETAILED DESCRIPTION OF THE INVENTION

Figure 1A:
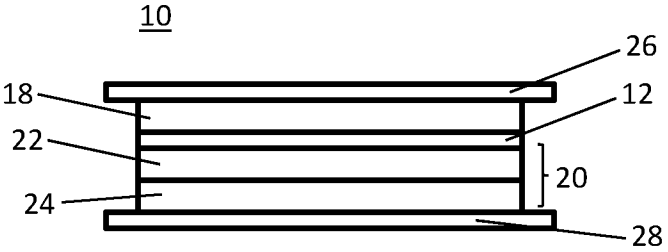
FIG. 1A is a cross-sectional view of a rug tab as described herein.

As shown in FIGS. 1-9D, a rug tab 10 that includes a support material 12, having an upper side 14 and a lower side 16; an upper adhesive layer 18 applied on an upper side 14 of the support material 12; and a lower adhesive layer 20 applied on an lower side 16 of the support material 12. In some embodiments, (i) an upper adhesive layer sheer force is at least 25% greater than a lower adhesive layer sheer force, (ii) an upper adhesive layer peel force is at least twice a lower adhesive layer peel force, or (iii) both options (i) and (ii), where the force values are measured one hour after application of an applicable adhesive layer to a target surface (e.g., a rug ("R") or the floor ("F")). The rug tab 10 is adapted for the upper adhesive layer to grip the underside of a rug relatively aggressively, while the lower adhesive layer adheres to the floor well enough to hold the rug in place without damaging the floor. In addition, the rug tab 10 can be easily removed (peeled-up) from the floor (F) by the user and prevents the corners or edges of the rug from rolling up or curling up. As evident from FIGS. 4 and 5, the rug tabs 10 are applied entirely within the area of the rug and do not extend outside the perimeter of the rug.

The description of the preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise, and includes terms such as "directly" coupled, secured, etc. The term "operatively coupled" is such an attachment, coupling, or connection that allows the pertinent structures to operate as intended by virtue of that relationship. As used herein, the term "rug" is intended to encompass rugs, as well as, mats.

In some embodiments, the rug tab 10 has a shape selected from the group consisting of a rectangle, a square, a triangle, a strip, a circle, and an ellipse.

In some embodiments, the support material 12 is selected from the group consisting of a permeable material (i.e., a material comprising spaces therein) and an impermeable material. In some embodiments, the support material 12 is a flexible material, a foldable material, or both. In some embodiments, the support material 12 is formed from a fabric, a scrim, a mesh, and a film. In some embodiments, the support material 12 is formed from a material selected from the group consisting of nylon, rayon, polyester, polypropylene, polyethylene, polyester, fiberglass, paper, and polystyrene.

Figure 3A:
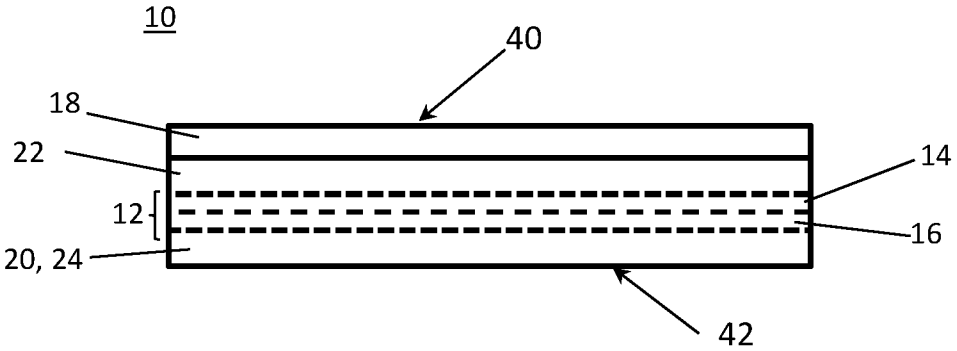
FIG. 3A is a cross-sectional view of another rug tab as described herein.
Figure 3B:
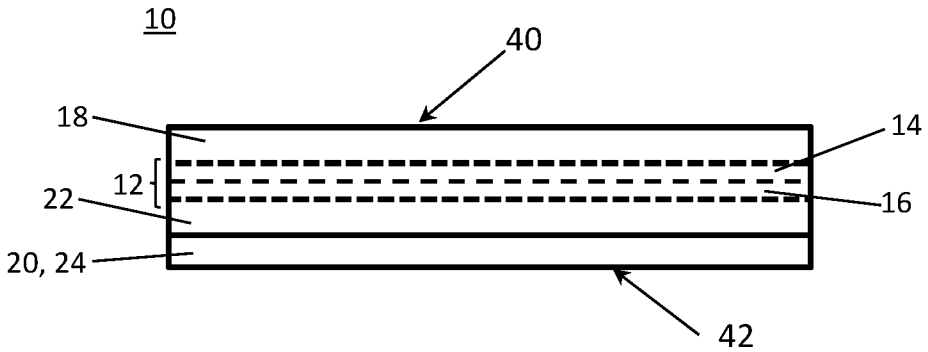
FIG. 3B is a cross-sectional view of another rug tab as described herein.

In some embodiments, as shown in FIGS. 3A and 3B, the upper adhesive layer 18, the lower adhesive layer 20, or both extend into spaces within the support material 12. In some embodiments, the support material 12 is a fabric (including a scrim or mesh) and the upper adhesive layer 18, the lower adhesive layer 20, or a combination of both encapsulate the fibers forming the support material 12.

Figure 1B:
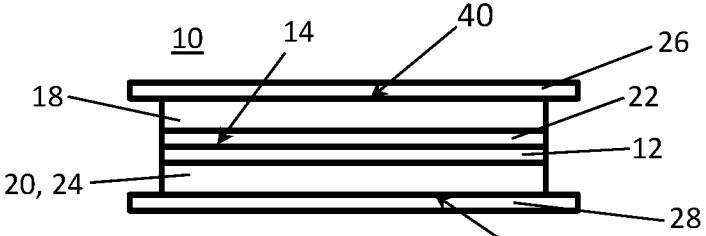
FIG. 1B is a cross-sectional view of another rug tab as described herein.
Figure 1C:
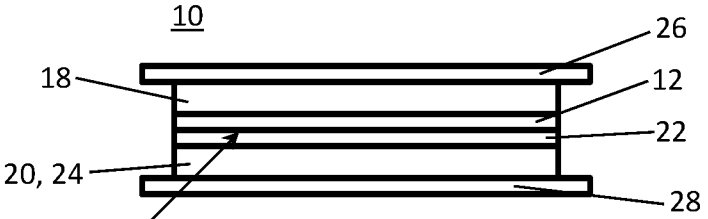
FIG. 1C is a cross-sectional view of another rug tab as described herein.
Figure 2:
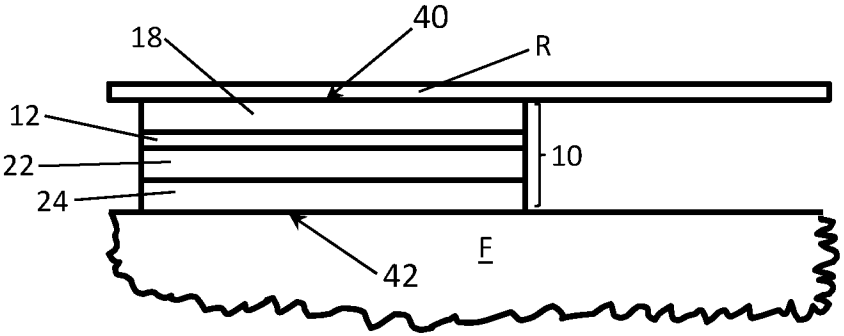
FIG. 2 is a cross-sectional view of a rug tab attached to a rug and the floor as described herein.

In some embodiments, a barrier layer 22 is located between the upper adhesive layer 18 and the lower adhesive layer 20. In some embodiments, as shown in FIG. 1A, a portion of the barrier layer 22 is embedded within the support material 12. In some embodiments, as shown in FIG. 1B (with reference to FIG. 3A), the barrier layer 22 is above or extends above the upper side 14 of the support material 12. In some embodiments, as shown in FIG. 1C (with reference to FIG. 3B), the barrier layer 22 is below or extends below the lower side 16 of the support material 12. In some embodiments, the support material 12 is the barrier layer 22. In some embodiments, the barrier layer 22 is selected from the group consisting of a film, a polymer, and an adhesive. In some embodiments, the barrier layer 22 comprises a permanent adhesive (e.g., a permanent acrylic adhesive), while the barrier layer 22 comprises a releasable adhesive (e.g., a releasable acrylic adhesive) in other embodiments. As used herein, "barrier layer" is user to reference a layer that enables the lower adhesive layer 20 and the upper adhesive layer 18 to maintain the claimed peel force and sheer force properties for a period of at least one year under standard storage conditions. This ensures that the lower adhesive layer 20 will adhere to the target surface (e.g., a wall, a floor, a table, cushion to a chair, picture to a refrigerator, etc.) during use, but is easily peeled from the floor by the user over the lifetime of the rug tab 10 without causing damage to the floor (F). Although the specification refers to the floor as an example of a target surface, it will be understood that floor is merely an example of a target surface and the methods and instructions disclosed herein apply to other target surfaces (e.g., walls) where a rug may be displayed or used.

In some embodiments, the lower adhesive layer 20 comprises an adhesive-based barrier layer 22 and a releasable pressure sensitive lower adhesive layer 24, wherein a portion of the barrier layer 22 is between the support material 12 and the releasable pressure sensitive adhesive layer 24. In some embodiments, the barrier layer 22 is a permanent adhesive barrier layer. In some embodiments, the barrier layer 22 is selected from a hot-melt adhesive and a dispersion adhesive. In some embodiments, the barrier layer 22 is formed of paper, a non-woven material (e.g., spunbond, meltblown, polymer film, etc.), or a combination of both.

In some embodiments, the upper adhesive layer 18 is a releasable, pressure sensitive adhesive. In some embodiments, the upper adhesive layer 18 is applied as an acrylic dispersion.

In some embodiments, the rug tab 10 includes an upper releasable liner 26, where the upper adhesive layer 18 is between the upper side 14 and the upper releasable liner 26. In some embodiments, the rug tab 10 includes a lower releasable liner 28, where the lower adhesive layer 20 is between the lower side 16 and the lower releasable liner 28. As used herein, the upper releasable liner 26 is on the rug side of the layered rug tab 10 and the lower releasable liner 28 is on the floor side of the layered rug tab 10.

Figure 6:
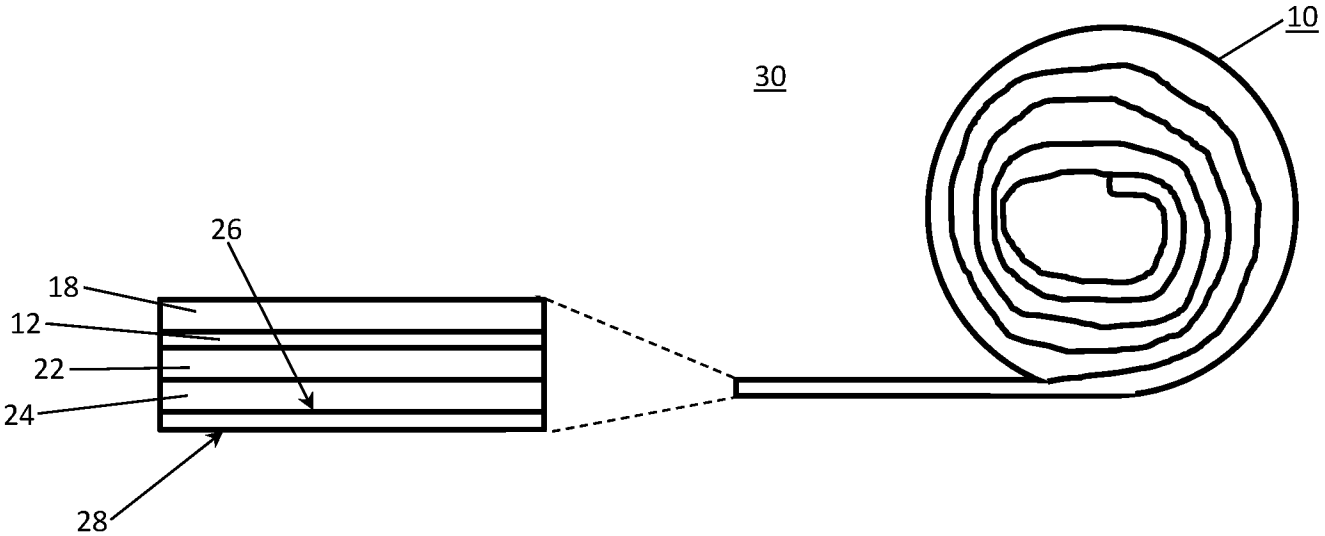
FIG. 6 is a side view of a rug tab strip that is rolled so that opposite sides of the same releasable liner serve as the upper and lower releasable liner.

As shown in FIG. 6, the rug tab 10 is a strip that is rolled and the upper releasable liner 26 and the lower releasable liner 28 are opposite sides of the same releasable liner.

Figure 8A:
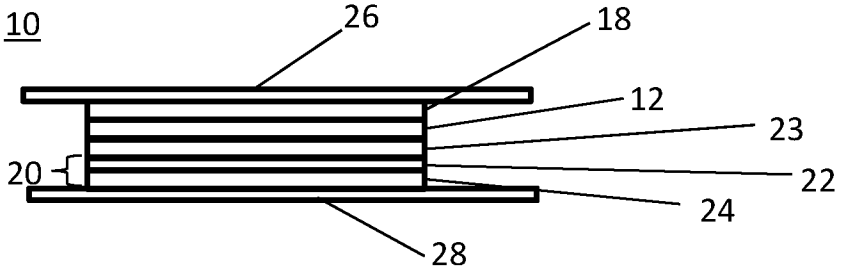
Figure 8B:
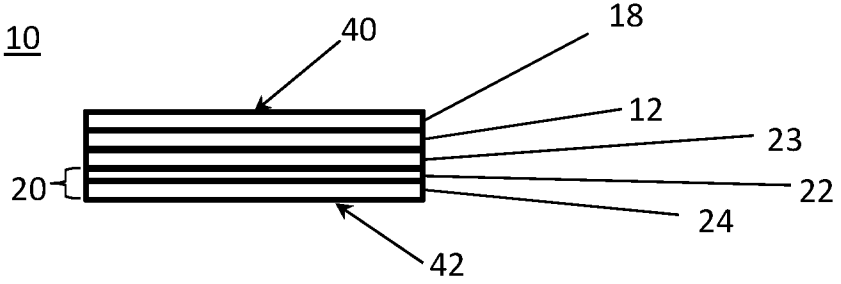
FIG. 8B is a cross-sectional view of the rug tab.

As shown in FIGS. 8A and 8B, in some embodiments, the rug tab 10 includes a lower spacer layer 23 between the support material 12 and the barrier layer 22. The lower spacer layer 23 can be an adhesive layer. In some embodiments, the adhesive is a wet adhesive that cures over time to form a permanent bond, while the adhesive can be a dry adhesive in other embodiments. FIG. 8A includes the upper and lower releasable liners 26, 28, while FIG. 8B shows the same rug tab 10 with the upper and lower releasable liners 26, 28 removed.

In some embodiments, as shown in FIGS. 9A-9D, a reinforced rug tab 90 is disclosed. In some embodiments, the reinforced rug tab 90 includes an upper rug tab $\mathbf{10}_1$ and a lower rug tab $\mathbf{10}_2$ with a reinforcing material 43 sandwiched therebetween. FIGS. 9A-9D only show the upper adhesive layer 18, the support material 12, and the lower adhesive layer 20 for each of the rug tabs $\mathbf{10}_1$, $\mathbf{10}_2$; however, it is understood that any of the rug tabs 10 disclosed herein can be used as the upper or lower rug tab $\mathbf{10}_1$, $\mathbf{10}_2$. The reinforcing material is intended to impart some rigidity to the reinforced rub tag 90 in order to prevent the edges of the rug to which it is attached from curling.

In some embodiments, the reinforcing material 43 is formed of a polymer selected from the group consisting of vinyl (e.g., marine vinyl), paperboard, PVC, plastic, metal, or any other material with sufficient rigidity not to bend and stiff enough to resist deformation in response to an applied force to the material (e.g., rug) it is securing to another surface (e.g., floor or wall).

In some embodiments, the reinforcing material 43 has a stiffness or moment of force of 0.01 to 100 millinewton meters (mN·m). For example, moment of force for the reinforcing material can range from 0.01 to 1 mN·m, from 1 to 0.800 mN·m, from 0.01 to 5 mN·m, from 1 to 15 mN·m, from 15 to 25 mN·m, from 25 to 30 mN·m, or from 50 to 75 mN·m, or from 75 to 100 mN·m.

In some embodiments, the reinforcing material 43 has a stiffness or yield strength of 500 PSI to 100,000 PSI. For example, yield strength for the reinforcing material can range from 500 to 1,500 PSI, from 1,500 to 5,000 PSI, from 5,000 PSI to 15,000 PSI, from 10,000 to 50,000 PSI, or from 50,000-100,000 PSI.

In some embodiments, the reinforcing material 43 has a stiffness or tensile yield strength of 1 to 10 $\sigma_y$. For example, tensile yield strength for the reinforcing material can range from 1 to 5 $\sigma_y$, from 6 to 9 $\sigma_y$, or from 5 to 10 $\sigma_y$.

In some embodiments, the reinforcing material 43 has a thickness ranging from 0.015 to 0.040 mm.

In some embodiments, the reinforcing material 43 is a film or sheet of material. In some embodiments, the reinforcing material 43 has a thickness ranging from 0.01 mm to 14.5 mm, or from 0.015 mm to 0.040 mm.

FIGS. 9A-9D include dashed representations of the upper and lower release liners 26, 28 to show which side is intended to attach to the rug and the floor, respectively. The upper-most layer 44 will be covered by the upper release liner 26, while the lower-most layer 46 will be covered by the lower release liner 28.

Figure 9A:
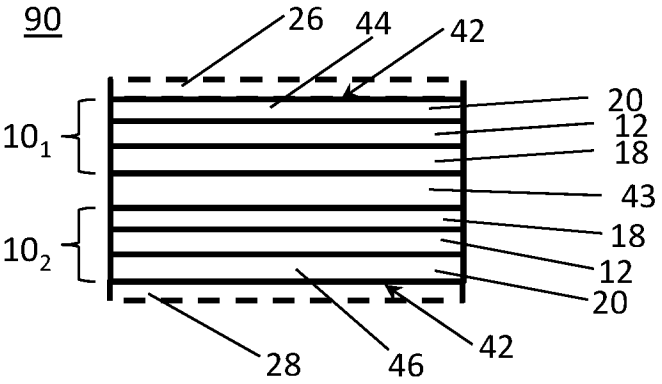
FIG. 9A is a cross-sectional view of a first embodiment of a reinforced rug tab.
Figure 9B:
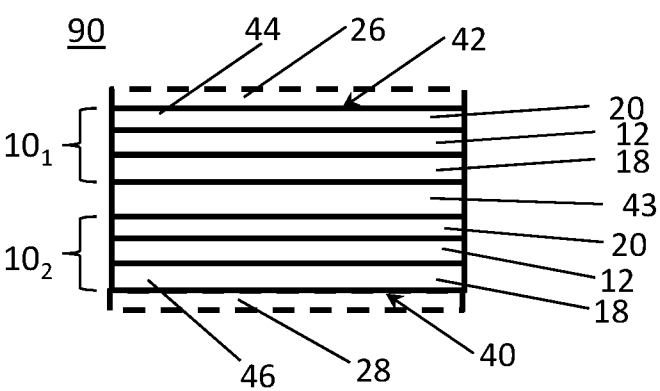
FIG. 9B is a cross-sectional view of a second embodiment of a reinforced rug tab.
Figure 9C:
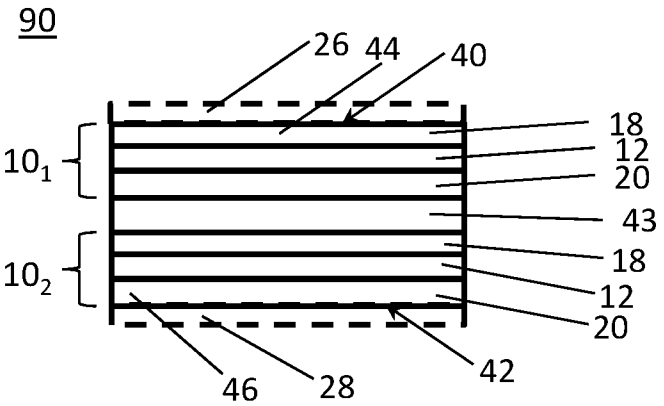
FIG. 9C is a third embodiment of a reinforced rug tab.
Figure 9D:
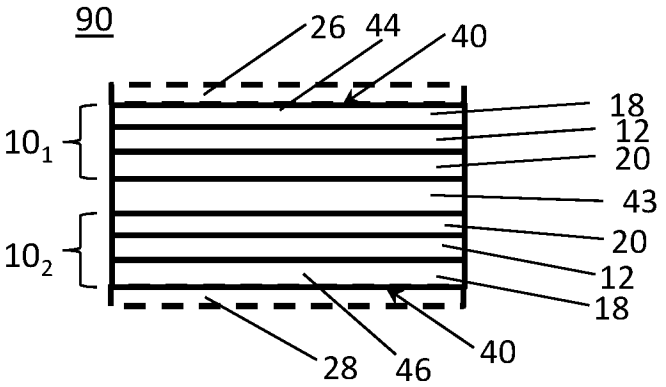
FIG. 9D is a fourth embodiment of a reinforced rug tab.

In some embodiments, as shown in FIG. 9A, the upper-most layer 44 includes the lower adhesive layer 42 of the upper rug tab $\mathbf{10}_1$ and is covered by the upper release liner 26 (i.e., rug side), while the lower-most layer 46 includes the lower adhesive layer 42 of the lower rug tab $\mathbf{10}_2$ and is covered by the lower release liner 28 (i.e., floor side). In some embodiments, as shown in FIG. 9B, the upper-most layer 44 includes the lower adhesive layer 42 of the upper rug tab $\mathbf{10}_1$ and the lower-most layer 46 includes the upper adhesive layer 40 of the lower rug tab $\mathbf{10}_2$. In some embodiments, as shown in FIG. 9A, the upper-most layer 44 includes the upper adhesive layer 40 of the upper rug tab $\mathbf{10}_1$ and the lower-most layer 46 includes the lower adhesive layer 42 of the lower rug tab $\mathbf{10}_2$. In some embodiments, as shown in FIG. 9A, the upper-most layer 44 includes the upper adhesive layer 40 of the upper rug tab $\mathbf{10}_1$ and the lower-most layer 46 includes the upper adhesive layer 40 of the lower rug tab $\mathbf{10}_2$.

In some embodiments, the upper adhesive layer sheer force at one hour is at least 35 pounds per square inch (psi), or at least 37.5 psi, or at least 40 psi, or at least 42.5 psi, or at least 45 psi. In some embodiments, the upper adhesive layer sheer force at twenty-four hours is at least 35 psi, or at least 37.5 psi, or at least 40 psi, or at least 42.5 psi, or at least 45 psi.

In some embodiments, the lower adhesive layer sheer force at one hour is at least 20 psi, or at least 22.5 psi, or at least 25 psi, or at least 27.5 psi, or at least 30 psi. In some embodiments, the lower adhesive layer sheer force at twenty-four hours is at least 20 psi, or at least 22.5 psi, or at least 25 psi, or at least 27.5 psi, or at least 30 psi, or at least 32.5 psi.

In some embodiments, the lower adhesive layer sheer force at one hour is 40 psi or less, or 39 psi or less, or 38 psi or less, or 37 psi or less, or 36 psi or less, or 35 psi or less, or 34 psi or less, or 33 psi or less. In some embodiments, the lower adhesive layer sheer force at twenty-four hours is 40 psi or less, or 39 psi or less, or 38 psi or less, or 37 psi or less, or 36 psi or less.

In some embodiments, the upper adhesive layer peel force at one hour is at least 2.5 psi, or at least 2.75 psi, or at least 3 psi, or at least 3.25 psi, or at least 3.5 psi. In some embodiments, the upper adhesive layer peel force at twenty-four hours is at least 2.5 psi, or at least 2.75 psi, or at least 3 psi, or at least 3.25 psi, or at least 3.5 psi, or at least 3.75 psi.

In some embodiments, the lower adhesive layer peel force at one hour is at least 0.5 psi, or at least 0.6 psi, or at least 0.7 psi, or at least 0.75 psi. In some embodiments, the lower adhesive layer peel force at twenty-four hours is at least 0.5 psi, or at least 0.6 psi, or at least 0.7 psi, or at least 0.75 psi, or at least 0.8 psi, or at least 0.85 psi.

In some embodiments, the lower adhesive layer peel force at one hour is 1.5 psi or less, or 1.3 psi or less, or 1.1 psi or less, or 1.0 psi or less, or 0.9 psi or less. In some embodiments, the lower adhesive layer peel force at twenty-four hours is 1.5 psi or less, or 1.3 psi or less, or 1.1 psi or less, or 1.0 psi or less, or 0.95 psi or less.

As will be understood, for any of the peel force and shear force values disclosed herein, the lower adhesive layer corresponds to the lower-most layer of a reinforced rug tab 90 and the upper adhesive layer corresponds to the upper-most layer of a reinforced rug tab 90.

The sheer force values reported herein are obtained using ASTM D6004 with a stainless steel underlayment. The peel force values reported herein are obtained using ASTM D3167 with a stainless steel as the rigid adherend. The only change was that a one day test was performed instead of a ten day test.

In some embodiments, the one hour sheer force for the upper adhesive layer is at least 35% greater than the one hour sheer force of the lower adhesive layer. In some embodiments, the one hour sheer force for the upper adhesive layer is at least 37.5% greater than, or at least 40% greater than, or at least 42.5% greater than, or at least 45% greater than, the one hour sheer force of the lower adhesive layer.

In some embodiments, the twenty-four hour sheer force for the upper adhesive layer is at least 27.5% greater than the twenty-four hour sheer force of the lower adhesive layer. In some embodiments, the twenty-four hour sheer force for the upper adhesive layer is at least 30% greater than, or at least 32.5% greater than, or at least 35% greater than, or at least 37% greater than, the twenty-four hour sheer force of the lower adhesive layer.

In some embodiments, the one hour peel force for the upper adhesive layer is at least 3 times the one hour peel force of the lower adhesive layer. In some embodiments, the one hour peel force for the upper adhesive layer is at least 3.5 times, or at least 3.75 times, or at least 4 times, or at least 4.25 times, or at least 4.5 times the one hour peel force of the lower adhesive layer.

In some embodiments, the twenty-four hour peel force for the upper adhesive layer is at least 3 times the twenty-four hour peel force of the lower adhesive layer. In some embodiments, the twenty-four hour peel force for the upper adhesive layer is at least 3.25 times, or at least 3.5 times, or at least 3.75 times, or at least 4 times, or at least 4.25 times the twenty-four hour peel force of the lower adhesive layer.

Figure 4:
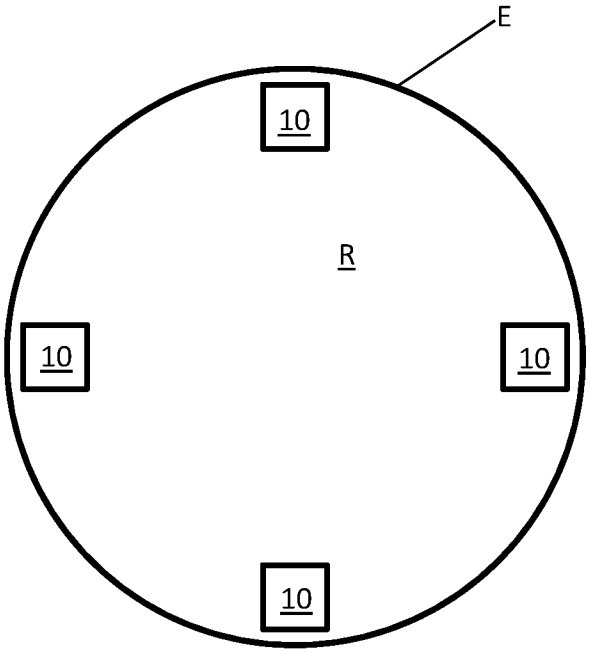
FIG. 4 is a bottom view of a circular rug with rug tabs attached as described herein.

In another embodiment, a method of stabilizing a rug is disclosed. The method can include providing a rug tab supply 30. The rug tab supply 30 can include a support material 12, having an upper side 14 and a lower side 16; an upper adhesive layer 18 applied on an upper side 14 of the support material 12; and a lower adhesive layer 20 applied on a lower side 16 of the support material 12. In some embodiments, (i) an upper adhesive layer sheer force is at least 25% greater than a lower adhesive layer sheer force, (ii) an upper adhesive layer peel force is at least twice a lower adhesive layer peel force, or (iii) both options (i) and (ii), wherein force values are measured one hour after application of an applicable adhesive layer to a target surface. The rug tab supply 30 can include any of the rug tabs 10 or reinforced rug tabs 90 described herein. The method can also include applying at least one rug tab 10 or reinforced rug tabs 90 (or at least two rug tabs 10 or reinforced rug tabs 90, or at least three rug tabs 10 or reinforced rug tabs 90, or at least four rug tabs 10 or reinforced rug tabs 90) from the rug tab supply 30 to an underside of a rug (R) using the upper adhesive layer 18; and applying the lower adhesive layer 20 of each rug tab 10 to a floor (F). The resulting configuration is shown in cross-section in FIG. 2. The method can include applying each of the rug tabs proximate to an edge (E) of the rug (R) and each rug tab 10 is spaced apart from the other rug tabs 10, as shown in FIGS. 4 & 5.

The method can also include applying at least one reinforced rug tab 90 (or at least two reinforced rug tabs 90, or at least three reinforced rug tabs 90, or at least four reinforced rug tabs 90) from the rug tab supply 30 to an underside of a rug (R) using the upper-most layer 44; and applying the lower-most layer 46 of each rug tab 10 to a floor (F). The resulting configuration is shown in cross-section in FIGS. 9A-9D, except that 26 represents the rug and 28 represents the floor. The method can include applying each of the at least four reinforced rug tabs 90 proximate to an edge (E) of the rug (R) and each reinforced rug tab 90 is spaced apart from the other reinforced rug tabs 90, as in the rug tab 10 configuration shown in FIGS. 4 & 5.

Figure 5:
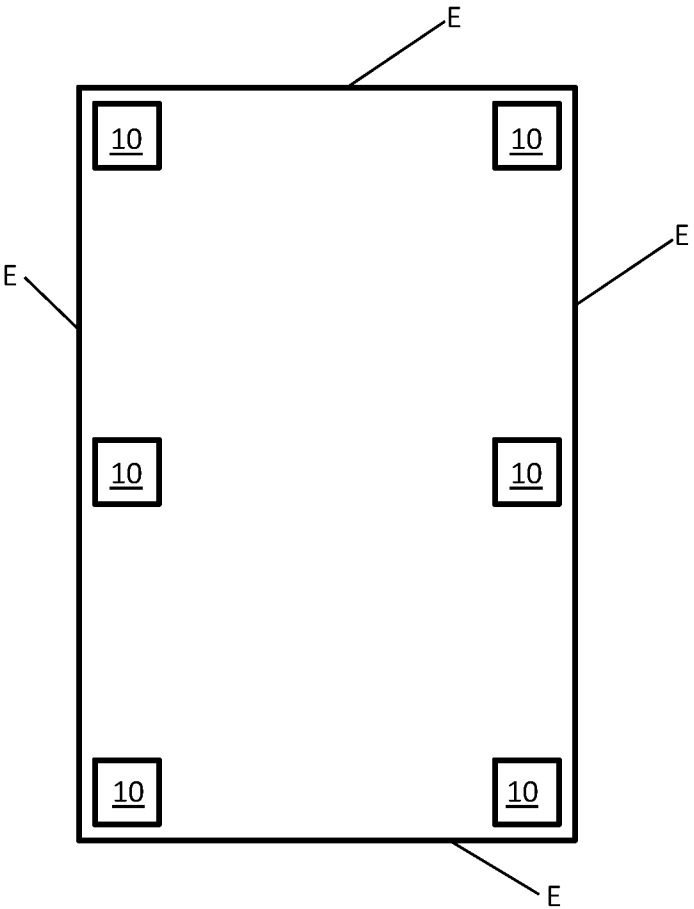
FIG. 5 is a bottom view of a rectangular rug with rug tabs attached as described herein.

As shown in FIG. 5, in some embodiments, the rug (R) comprises at least four corners, and the method includes applying a rug tab 10 (or a reinforced rug tab 90) proximate to each of the at least four corners. In some embodiments, as shown in FIG. 5, at least one rug tab 10 (or a reinforced rug tab 90) is placed proximate to an edge (E) of the rug (R) between two adjacent corners of the rug (R). In some embodiments, the rug tab supply 30 comprises at least four rectangular rug tabs 10 (or a reinforced rug tab 90).

In some embodiments, where an upper releasable liner 26 is used, the method includes removing the upper releasable liner 26 prior to applying the upper adhesive layer 18 of the rug tab 10 to the underside of the rug (R). In some embodiments, where a lower releasable liner 28 is used, the method includes removing the lower releasable liner 28 prior to applying the lower adhesive layer 20 of the rug tab 10 to the floor (F).

In some embodiments, where an upper releasable liner 26 is used, the method includes removing the upper releasable liner 26 prior to applying the upper-most layer 44 of the reinforced rug tab 90 to the underside of the rug (R). In some embodiments, where a lower releasable liner 28 is used, the method includes removing the lower releasable liner 28 prior to applying the lower-most layer 46 of the reinforced rug tab 90 to the floor (F).

In some embodiments, the rug tab supply 30 comprises a strip that is rolled and the upper releasable liner 26 and the lower releasable liner 28 are opposite sides of the same releasable liner. In some such embodiments, the method comprises cutting or tearing the rug tab supply 30 to form at least four rug tabs 10 or reinforced rug tabs 90.

Figure 7:
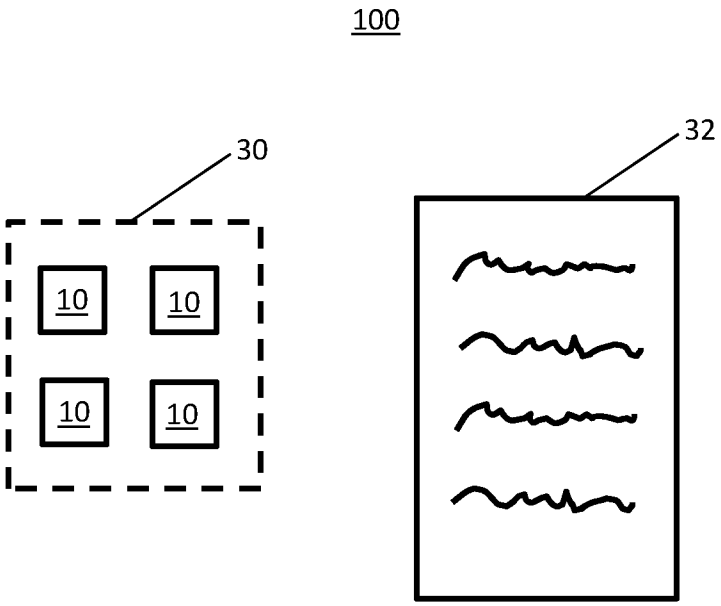
FIG. 7 is a schematic view of a rug tab kit as described herein.

In another embodiment, a kit 100 for stabilizing a rug is disclosed. As shown in FIG. 7, the kit includes a rug tab supply 30 comprising any of the rug tabs 10 (or reinforced rug tabs 90) as described herein and instructions 32 for using the rug tabs 10 (or reinforced rug tabs 90). The instructions 32 include applying at least four rug tabs 10 (or reinforced rug tabs 90) from the rug tab supply 30 to an underside of a rug (R) proximate to an edge (E) of the rug in a spaced apart arrangement, using the upper adhesive layer 18 (or upper-most layer 44), and applying the lower adhesive layer 20 (or lower-most layer 46) of each rug tab 10 (or reinforced rug tab 90) to a floor (F). The instructions 32 can also include applying a rug tab 10 (or reinforced rug tab 90) proximate each of the at least four corners of a square rug or rectangular rug, as shown in FIG. 5. The instructions can include any combination of the method steps described herein.

In some embodiments, the upper releasable liner 26 and the lower releasable liner 28 are different in appearance so that the user can easily distinguish between the upper side, which is adapted for adhesion (permanent or releasable) to a rug, and the lower side, which is adapted for releasable adhesion to the target surface (such as a floor or wall). In some embodiments, the instructions identify include reference to the difference in appearance so that the user knows which side of the rug tab 10 (or reinforced rug tab 90) to apply to the rug (R) and which side of the rug tab 10 (or reinforced rug tab 90) to apply to the target surface (e.g., floor or wall). In some embodiments, the upper releasable liner 26 and the lower releasable liner 28 can be distinguishable based on the presence or absence of printing, different printing, different colors, different patterns, or other differences in appearance that are recognizable by the user, particularly when referenced by the instructions 32.

EXAMPLES

A rug tab consistent with the structure disclosed in FIG. 1A was produced using a rayon scrim as the support material, a permanent acrylic dispersion adhesive applied to the rayon scrim as the barrier layer and a releasable acrylic dispersion applied to the rayon scrim as the upper adhesive layer. The lower adhesive layer was applied to the permanent acrylic dispersion adhesive. The upper and lower adhesive layers of the rug tab were then evaluated for peel strength and sheer strength using ASTM 3167 and ASTM D6004, respectively. The peel strength and sheer strength were recorded 1 hour after application of the adhesive to the target surface and 24 hours after application of the adhesive to the target surface. The resulting values were as follows:

| | 1 Hour | 24 Hours |
|---|---|---|
| Upper Adhesive Layer | | |
| Sheer | 45.7 psi | 48.3 psi |
| Peel | 3.7 psi | 3.9 psi |
| Lower Adhesive Layer | | |
| Sheer | 31.4 psi | 35 psi |
| Peel | 0.8 psi | 0.9 psi |

It was determined that these values allowed the upper adhesive layer to be aggressively attached to the rug without damage upon removal and, similarly, allowed the lower adhesive layer to be temporarily attached to the target surface without causing damage upon removal.

The sheer force values reported herein are obtained using ASTM D6004 with a stainless steel underlayment. The peel force values reported herein are obtained using ASTM D3167 with a stainless steel as the rigid adherend.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A reinforced rug tab comprising:

a reinforcing material;

a first rug tab applied above the reinforcing material; and a second rug tab applied below the reinforcing material, wherein the first rug tab comprises a first tab upper adhesive layer, a first tab lower adhesive layer, and a first tab support material between the first tab upper adhesive layer and the first tab lower adhesive layer, and wherein the second rug tab comprises a second tab upper adhesive layer, a second tab lower adhesive layer, and a second tab support material between the second tab upper adhesive layer and the second tab lower adhesive layer.

2. The reinforced rug tab of claim 1, wherein an upper-most layer of the first rug tab is first tab upper adhesive layer and a lower-most layer of the second rug tab is second tab upper adhesive layer.

3. The reinforced rug tab of claim 1, wherein an upper-most layer of the first rug tab is first tab upper adhesive layer and a lower-most layer of the second rug tab is second tab lower adhesive layer.

4. The reinforced rug tab of claim 1, wherein an upper-most layer of the first rug tab is first tab lower adhesive layer and a lower-most layer of the second rug tab is second tab upper adhesive layer.

5. The reinforced rug tab of claim 1, wherein an upper-most layer of the first rug tab is first tab lower adhesive layer and a lower-most layer of the second rug tab is second tab lower adhesive layer.

6. The reinforced rug tab of claim 1, further comprising an upper releasable liner attached to an upper-most layer of the first rug tab and a lower releasable liner attached to a lower-most layer of the second rug tab.

7. The reinforced rug tab of claim 1, wherein (i) a shear force of an upper-most layer of the first rug tab is at least 25% greater than a shear force of a lower-most layer of the second rug tab, (ii) a peel force of the upper-most layer of the first rug tab is at least twice a peel force of the lower-most layer of the second rug tab, or (iii) both options (i) and (ii), wherein force values are measured one hour after application of a respective upper-most or lower-most layer to a target surface.

8. The reinforced rug tab of claim 1, wherein the reinforcing material is selected from the group consisting of vinyl, paperboard, PVC, plastic, and metal.

9. The reinforced rug tab of claim 1, wherein the reinforcing material has a thickness of 0.01 mm to 14.5 mm.

10. The reinforced rug tab of claim 1, wherein the first rug tab further includes a first barrier layer between the first tab upper adhesive layer and the first tab lower adhesive layer.

11. The reinforced rug tab of claim 10, further comprising a first lower spacer layer, wherein the first barrier layer is between the first lower spacer layer and the first tab lower adhesive layer.

12. The reinforced rug tab of claim 10, wherein the second rug tab further comprises a second barrier layer between the second tab upper adhesive layer and the second tab lower adhesive layer.

13. The reinforced rug tab of claim 12, further comprising:

a first lower spacer layer, wherein the first barrier layer is between the first lower spacer layer and the first tab lower adhesive layer, and a second lower spacer layer, wherein the second barrier layer is between the second lower spacer layer and the second tab lower adhesive layer.

14. The reinforced rug tab of claim 1, wherein (a) the first tab support material comprises spaces therein, and the first tab upper adhesive layer, the first tab lower adhesive layer, or both extend into the spaces within the first tab support material, (b) the second tab support material comprises spaces therein, and the second tab upper adhesive layer, the second tab lower adhesive layer, or both extend into the spaces within the second tab support material, or (c) both (a) and (b).

15. The reinforced rug tab of claim 1, wherein (i) a peel force of a lower-most layer is in a range from 0.7 to 1.5 psi and a shear force of an upper-most layer is at least 25% greater than a shear force of the lower-most layer, (ii) a shear force of the lower-most layer is in a range from 20 to 40 psi, and a peel force of the upper-most layer is at least twice a peel force of the lower-most layer, or (iii) both options (i) and (ii), wherein force values are measured one hour after application of a respective upper or lower adhesive layer to a target surface.

16. The reinforced rug tab of claim 1, wherein, at 1 hour, an upper-most layer shear force is at least 35 psi and a lower-most layer shear force is at least 20 psi.

17. The reinforced rug tab of claim 1, wherein, at 1 hour, an upper-most layer peel force is at least 2.5 psi and a lower-most layer peel force is at least 0.5 psi.

18. The reinforced rug tab of claim 1, wherein (i) at 1 hour, an upper-most layer shear force is at least 35% greater than a lower-most layer shear force, (ii) at 1 hour, an upper-most layer peel force is at least three times a lower-most layer peel force, or (iii) both options (i) and (ii).

19. The reinforced rug tab of claim 1, wherein, at 1 hour, a lower-most layer peel force is in a range from 0.5 to 1.5 psi, and wherein, at 1 hour, a lower-most layer shear force is in a range from 20 to 40 psi.

20. The reinforced rug tab of claim 6, wherein the reinforced rug tab is a strip that is rolled and the upper releasable liner and the lower releasable liner are opposite sides of the same releasable liner.

* * * * *